United States Patent [19]

Wuermli

[11] 4,445,323

[45] May 1, 1984

[54] APPARATUS FOR THE CONJOINT GRIPPING OF BOBBINS ON A RING SPINNING OR RING-TWISTING MACHINE

[75] Inventor: Arthur Wuermli, Winterthur, Switzerland

[73] Assignee: Rieter Machine Works Limited, Winterthur, Switzerland

[21] Appl. No.: 432,558

[22] Filed: Oct. 4, 1982

[30] Foreign Application Priority Data

Oct. 29, 1981 [CH] Switzerland ..... 6911/81

[51] Int. Cl.[3] ..... D01H 9/08; B66C 1/46

[52] U.S. Cl. ..... 57/275; 294/87 R

[58] Field of Search ..... 57/273–275, 57/266; 294/64 R, 87 R, 88, 93, 99 R

[56] References Cited

U.S. PATENT DOCUMENTS

| | | | |
|---|---|---|---|
| 3,367,098 | 2/1968 | Schulz | 57/275 |
| 3,462,934 | 8/1969 | Schulz et al. | 57/275 |
| 3,714,770 | 2/1973 | Rothke | 57/275 |
| 3,835,633 | 9/1974 | Klein | 57/275 |
| 4,120,526 | 10/1978 | Rohner | 294/87 R |

*Primary Examiner*—John Petrakes

*Attorney, Agent, or Firm*—Werner W. Kleeman

[57] ABSTRACT

An apparatus for the conjoint gripping of bobbins by means of pins or spigots formed of a rigid material, mounted at a support or carrier, and insertable into the bobbins. An expansible hose or tube member extends lengthwise of the support, this hose member when subjected to an increased internal pressure serving to press the bobbins against the pins or pin members inserted therein. This known apparatus has the advantage that there does not occur damage to the entering pin members, nor does there arise permanent deformation or destruction thereof. Yet, such apparatus possesses the shortcomings that the seized bobbins, when pressed against the pin members, are not positioned with sufficient accuracy in a direction parallel to the longitudinal direction of the support. The invention avoids such drawback in that, there are provided two straight edges at each pin member at the side thereof confronting the hose member, such too straight edges extending in the longitudinal direction of the related pin member and serving as contact surfaces for the bobbin pressed thereagainst.

7 Claims, 3 Drawing Figures

APPARATUS FOR THE CONJOINT GRIPPING OF BOBBINS ON A RING SPINNING OR RING-TWISTING MACHINE

BACKGROUND OF THE INVENTION

The present invention relates to a new and improved apparatus for the conjoint gripping or seizing of bobbins on a textile machine, especially a ring-spinning or ring-twisting machine.

In its more specific aspects, the apparatus for the common gripping of empty or wound bobbins on a ring-spinning or ring-twisting machine, is of the type comprising pin members or spigots which are insertable into the bobbins, are formed of a rigid material, and are mounted on a support or carrier extending along the textile machine. Further, there is provided a hose or tube member which extends along the support, the internal pressure of the hose member being variable. The hose member extends in the lengthwise direction of the support between an abutment and the pin members and serves the purpose, when subjected to an increased internal pressure, of pressing the bobbins against the pin members inserted therein.

From the German Pat. No. 1,282,526 and the German Patent Publication Nos. 1,710,054 and 2,220,861 it is already known in this art to insert respective grippers into the interior of each of the bobbins for the conjoint gripping or seizing of the bobbins or the bobbins together with the thread packages wound thereon. Thereafter, these grippers are expanded by means of a pressurized fluid medium, with the result that the bobbins are retained by these grippers.

The gripping of the bobbins in the aforedescribed manner is associated with a number of drawbacks. For instance, if there is present an inexact positioning of the bobbins it can happen that during insertion of the grippers into the bobbins a gripper will graze or strike the bobbin at its upper edge. Since the wall of the gripper is formed of an elastic or flexible material there exists a certain danger that it will be damaged. Equally, it also repeatedly happens that during the conjoint gripping action a bobbin is missing at certain positions for various operational reasons. Since all of the grippers are connected to the same pressurized fluid medium and are conjointly expanded, there prevails the danger that the grippers which do not find any bobbins into which they can enter will over expand so that they experience a permanent deformation or even tend to burst.

These drawbacks can be avoided with an apparatus of the initially mentioned type which can be constructed, for instance, in accordance with the teachings of the German Pat. No. 2,062,535. In contrast to the use of grippers which expand when pressurized, here the hose or tube member always experiences approximately the same conditions, irrespective of whether or not there is present a bobbin. Even if there is not present a bobbin the pin member, which is present at the site of the missing bobbin, counteracts an overexpansion of the hose member. Damage to the pin members during their immersion into the bobbins is avoided because these pin members are formed of a rigid or solid material.

A feature of the apparatus disclosed in the aforementioned German Pat. No. 2,062,535 is that the bobbins clamped between the circular-cylindrical shaped grippers or pin members and the hose member or tube are retained with great accuracy as concerns swinging movements occurring about the pin members in a direction normal to the longitudinal direction of the support or carrier. However, the positioning of the bobbins with regard to swinging movements of the bobbins parallel to the longitudinal direction of the support is not fixed with the necessary precision.

SUMMARY OF THE INVENTION

Therefore, with the foregoing in mind it is a primary object of the present invention to avoid the aforementioned shortcomings of the prior art proposals.

Another and more specific object of the present invention aims at the provision of an apparatus of the character described wherein the bobbin when in a clamped condition, assumes a single, exactly determined position also in a direction parallel to the support, independent of whether the pin member has been exactly or inexactly inserted into the bobbin for gripping the bobbin.

Still a further significant object of the present invention is directed to a new and improved construction of apparatus for conjointly gripping bobbins of a textile machine, specifically a ring-spinning or ring-twisting, which apparatus is relatively simple in construction and design, quite economical to manufacture, highly reliable in operation, not readily subject to breakdown or malfunction and requires a minimum of maintenance and servicing.

Now in order to implement these and still further objects of the invention, which will become more readily apparent as the description proceeds, the gripping apparatus of the present development is manifested by the features that each pin member or spigot is provided with a side surface at a side thereof confronting the hose member. This side surface is bounded by two substantially straight edges which extend in the lengthwise direction of the related pin member. These edges, when the bobbin is pressed against such pin member, serve as an abutment or contact means for the internal surface of the bobbin.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
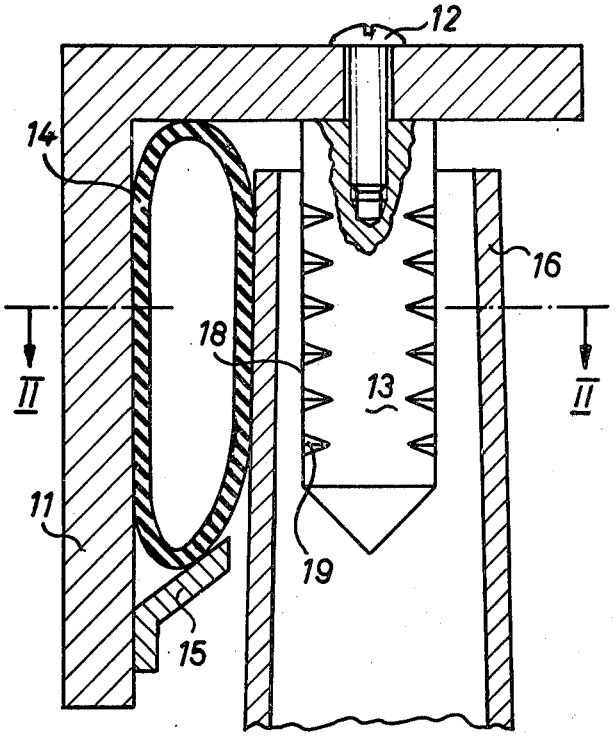
FIG. 1 is a sectional view perpendicular to the lengthwise direction of the support or carrier.
Figure 2:
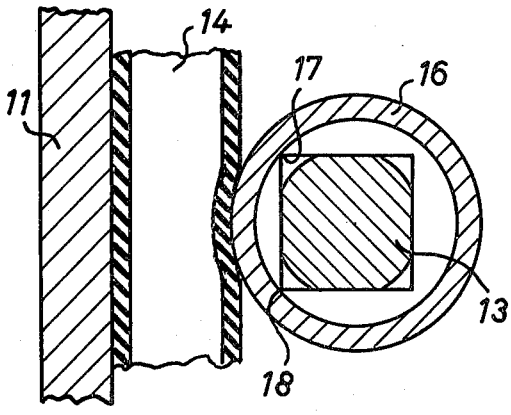
FIG. 2 is a sectional view of the arrangement of FIG. 1 taken substantially along the line II—II thereof.

Describing now the drawings, in FIGS. 1 and 2 there has been illustrated a support member or carrier 11 which extends in the longitudinal or lengthwise direction of a suitable textile machine, such as typically a ring-spinning or ring-twisting machine which has not been further illustrated since the details thereof are unimportant as concerns the teachings of the invention. Pin members or spigots 13 formed of a suitable rigid or solid material are secured by means of the threaded bolts or screws 12 or equivalent fastening expedients to the support member or carrier 11. A multiplicity of such pin members 13 are located at regular spaced intervals from one another in the longitudinal direction of the support member 11, in other words, in a direction extending perpendicular to the plane of the drawings. A flexible hose or tube member 14 also extends in the longitudinal or lengthwise direction of the support member 11. This hose member 14 is retained at the support member 11 and also at a rail or rail member 15 or equivalent structure. The support member 11 forms an abutment or support for the hose member 14. Reference character 16 indicates a bobbin which serves for winding of roving or yarn thereon, and into such bobbin 16 there can be inserted a related pin member or spigot 13. This pin member 13 is conically tapered at its end constituting the leading or free end during insertion of the pin member 13 into the related bobbin 16.

In order to be able to grip or seize bobbins 16 which are arranged in a row and mutually spaced from one another at essentially the same spacing as the pin members 13, the support or carrier member 11 is moved in such a manner that each pin member 13 is inserted from above into the interior or internal space of a related bobbin 16. After the pin members 13 have reached their full depth of insertion then the air pressure in the internal space or interior of the hose member 14 is increased. The hose member 14 thus expands, while being supported by the support or carrier member 11, towards the pin members 13, and consequently, each bobbin 16 is snugly pressed against a related pin member or spigot 13. Hence, each bobbin 16 is retained by a respective pin member 13 and the portion of the hose or tube member 14 located adjacent to such pin member 13. In this way it is possible for all of the bobbins 16 of a row of such bobbins to be simultaneously gripped or seized, and by raising the support member 11 these gripped bobbins 16 can be conjointly lifted-off or doffed.

Each bobbin 16 is pressed against its related pin member 13 by increasing the pressure internally of the hose or tube member 14. Consequently, the bobbin 16 is firmly retained between its related pin member 13 and the hose member 14 can be lifted-off by raising of the support member 11 as previously explained. The bobbin 16 engages the related pin member or spigot 13 along the lengthwise edges 17 and 18, as best seen by referring to FIG. 2. Hence, such bobbin 16 is held in an exactly defined position. Even if the bobbin 16, prior to the lifting thereof, is located in a position deviating from its prescribed position, then it is brought exactly into the prescribed position, at the latest after the lifting-off operation, by pressing such bobbin against the pin member 13 and due to the engagement of the bobbin by the two essentially straight edges 17 and 18 of the pin member 13, so that during subsequent re-donning such bobbin is set exactly in its predetermined position.

With the presently known apparatuses discussed at the outset of this disclosure, the pin members or spigots are formed to possess a substantially circular-cylindrical configuration. With these designs each bobbin 16 comes into mutual engagement with a respective pin member along a single line or generatrix located on the outer surface of such pin member. Therefore, there is achieved a retention of the bobbin 16 which is exactly defined in a direction normal or perpendicular to the longitudinal direction of the support member 11, but there cannot be prevented deviations, within certain limits, in a direction parallel to the longitudinal direction of the support member 11. This drawback is avoided with the apparatus of the present invention.

In order to increase the ability of the straight edges 17 and 18 to grip the internal surface or inner wall of the bobbin 16 there are advantageously provided grooves 19 along these edges 17 and 18 and extending transversely thereto, as best seen by referring to FIG. 1. Consequently, there are formed interrupted edges 17 and 18.

Figure 3:
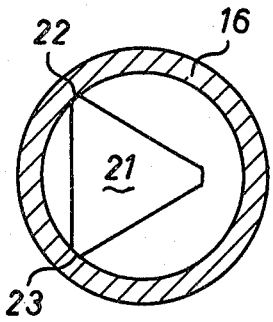
FIG. 3 is a top plan view of a triangular-shaped pin member or spigot.

While with the arrangement of FIGS. 1 and 2 the pin members 13 possess a prismatic shape, and specifically a quadrangular or square cross-sectional configuration, FIG. 3 illustrates a modified construction of the pin members, wherein the depicted pin member or spigot has a substantially triangular-shaped cross-sectional configuration. There is again shown a bobbin 16 which is pressed against its related pin member 21. As revealed by inspecting such FIG. 3, this pin member or spigot 21 has two edges 22 and 23 against which the bobbin 16 engages when it is pressed against such pin member 21. As shown for this embodiment, the edges 22 and 23 are constructed as broken or bevelled edges. Hence, there is realised a particularly protective handling of the bobbin 16.

In order to increase the gripping capability of the bobbin 16 on the pin members, such as the pin member 13 of FIGS. 1 and 2 or the pin member 21 of the arrangement of FIG. 3, the gripping ability of the edges 17, 18 (FIGS. 1 and 2) and the edges 22 and 23 (FIG. 3) can be additionally increased. This can be achieved, for instance, by roughening these edges or by the already described provision of grooves 19 extending along such edges. Also, there can be provided along these edges a coating possessing a relatively great adhesion or gripping ability. If, for instance, with the pin members possessing a square or quadrangular cross-sectional configuration as depicted in FIGS. 1 and 2 there are formed grooves, such as the grooves 19, along the straight edges 17 and 18 by a turning process or other suitable machining operation, then the fabrication operation is simplified and rendered less expensive if all four edges are simultaneously provided with grooves.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for the conjoint gripping of empty or wound bobbins on a textile machine, especially ring-spinning or ring-twisting machines, comprising:

pin members formed of a rigid material and insertable into the bobbins which are to be gripped;

a support member extending along the textile machine;

said pin members being carried by said support member;

an expansible hose member extending along said support member, wherein the internal pressure of said expansible hose member can be varied;

said expansible hose member extending in the direction of the bobbins for pressing the bobbins against the pin members inserted therein when the internal pressure of the expansible hose member is increased;

each pin member having a side surface at a side thereof facing the hose member;

said side surface being bounded by two substantially straight edges extending in the lengthwise direction of its pin member; and said substantially straight edges serving as abutment means for an internal surface of the related bobbin when such bobbin is pressed against the pin member.

2. The apparatus as defined in claim 1, wherein:

each pin member possesses a substantially prismatic shape; and each of the side surfaces of said pin members which contain said two substantially straight edges being located in a plane extending substantially parallel to the longitudinal direction of said support member.

3. The apparatus as defined in claim 2, wherein:

each of said edges extending in the lengthwise direction of the pin member is provided with grooves formed by a turning machining operation.

4. The apparatus as defined in claim 1, wherein:

each pin member has a substantially quadrangular cross-sectional configuration.

5. The apparatus as defined in claim 1, wherein:

said two straight edges are structured such that they possess a relatively large gripping capability with an inner surface of the bobbin gripped by the pin member.

6. The apparatus as defined in claim 5, wherein:

the two edges are structured to possess grooves running transversely with respect to said two edges in order to increase said gripping capability of said two edges.

7. The apparatus as defined in claim 1, wherein:

said two edges are interrupted in the lengthwise direction of extent thereof.

* * * * *